US006272700B1

(12) United States Patent
Wickstrom

(10) Patent No.: US 6,272,700 B1
(45) Date of Patent: Aug. 14, 2001

(54) DUAL LAYER BEDDING OR SEATING PRODUCT

(75) Inventor: Brenda A. Wickstrom, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/494,049

(22) Filed: Jan. 28, 2000

(51) Int. Cl.[7] ..... A47C 23/30
(52) U.S. Cl. ..... 5/239; 5/252
(58) Field of Search ..... 5/239, 238, 236.1, 5/245, 252; 297/452.44, 452.49, 452.51

(56) References Cited

U.S. PATENT DOCUMENTS 198,546 * 12/1877 Lombart ..... 5/252
208,077 9/1878 Davis .
215,981 * 5/1879 Segar ..... 5/245 X
270,799 1/1883 Hiams .
414,390 11/1889 Farrell .
2,853,721 9/1958 Koenigsberg .
4,068,329 1/1978 Gross et al. .
4,100,631 7/1978 Slone .
5,231,712 8/1993 Edwards et al. .

* cited by examiner

*Primary Examiner*—Lynne H. Browne
*Assistant Examiner*—Fredrick Conley
(74) *Attorney, Agent, or Firm*—Wood, Herron & Evans, LLP

(57) ABSTRACT

A bedding or seating product comprising a base having a pair of end rails, a pair of side rails and a plurality of intermediate rails. A plurality of intermediate wooden slats are spaced above the intermediate rails of the base by a plurality of spacers which may be sinuous springs, other types of springs or structures. A plurality of modular springs are secured to the intermediate slats and extend upwardly therefrom. An upper wire grid is secured to coplanar upper portions of the modular springs.

18 Claims, 6 Drawing Sheets

DUAL LAYER BEDDING OR SEATING PRODUCT

FIELD OF THE INVENTION

This invention relates to bedding or seating products and more particularly to a bedding or seating product having an interior containing a dual layer of springs.

BACKGROUND OF THE INVENTION

Traditional box springs have been made which comprise a generally rectangular wooden base including a pair of end rails and a pair of side rails and a plurality of intermediate rails extending from one side rail to the other side rail. A plurality of spaced coil springs arranged in a matrix are supported by the end rails and intermediate rails of the box spring frame. The lower end turns of each of the coil springs are stapled or otherwise secured to the wooden rails of the box spring frame. At the other end of each of the coil springs the upper end turns of the coil springs are secured to a wire grid comprising a plurality of intersecting wires arranged in a crisscrossing pattern. A generally rectangular upper border wire extends around the periphery of the grid. The box spring frame, coil springs and upper grid are encased in an upholstered covering in order to complete the box spring. Such a box spring has uniform characteristics throughout due to the uniform nature of the spring matrix. Other types of bedding or seating products have been made in the same manner.

Bedding or seating products including box springs have also been made with modular springs or other configurations of springs different than conventional coil springs. For example, U.S. Pat. No. 4,068,329 discloses a plurality of modular springs supported by a box spring frame. A conventional wire grid is attached to the tops of the modular springs. Additionally, U.S. Pat. No. 5,231,712 discloses a box spring having a plurality of sinuous-shaped springs supported by the frame members and an upper grid attached to the upper ends of the sinuous springs.

Additionally, bedding or seating products including box spring assemblies have been constructed with a plurality of wooden slats or members in the interior thereof. U.S. Pat. Nos. 414,390; 270,799 and 2,853,721 all disclose mattresses which include a plurality of solid members extending either lengthwise or widthwise inside the interior of the mattress. These solid members are either wooden or metallic and are located between adjacent convolutions of a row or column of coil springs. However, none of these patents discloses a box spring with a plurality of parallel wooden members located inside the interior of the box spring, a layer of springs underneath the wooden members and a separate layer of springs above the wooden members, thus dividing the box spring into separate layers.

Therefore, it has been one objective of the present invention to provide a bedding or seating product having multiple layers separated by a series of wooden interior slats.

It has been a further objective of the present invention to provide a bedding or seating product such as a box spring having two distinct layers with different firmness characteristics due to the nature of the springs comprising the different layers.

It has been a further objective of the present invention to provide a bedding or seating product such as a box spring having a peripheral edge of a different firmness to that of the interior of the product due to the nature of the springs and their location inside the product.

SUMMARY OF THE INVENTION

The invention of this application which accomplishes these objectives comprises a bedding or seating product having a base comprising a pair of end rails, a pair of side rails and a plurality of intermediate rails. The intermediate rails may extend parallel the side rails, parallel the end rails or both, depending upon the size of the product and the desired application. The rails of the base are preferably wooden, but may be made of other materials.

A plurality of intermediate slats are spaced above the intermediate rails of the base. The intermediate slats are preferably wooden but may be metallic or any other material. A plurality of spacers extend between the intermediate slats and the intermediate rails of the box spring. Each of the spacers is secured to one of the intermediate slats and one of the intermediate rails of the base, thus spacing the intermediate slat directly above the intermediate rail of the base. In one preferred embodiment of the present invention, the spacers are a plurality of sinuous springs extending between the intermediate slats and corresponding intermediate rails of the base. However, the spacers may be other configurations of springs, or alternatively, blocks of foam or any other material.

A plurality of first modular springs are secured to the base around the periphery thereof. These first modular springs are all of approximately the same fixed height, which will be referred to as a first height for purposes of this application. In one preferred embodiment of the present invention, these peripheral modular springs extend upwardly from opposed end rails of the base and are spaced from one another. In this embodiment, each transversely extending internal row of springs between the end rails of the base has at least one first modular spring at each end thereof. These endmost first modular springs are supported by the intermediate rails of the base and extend upwardly therefrom.

Alternatively, rows of first modular springs may extend along the lengths of the opposed side rails of the base, spaced from one another. In this embodiment the internal rails of the base extend longitudinally, each supporting a row of springs. At the end of each row is at least one first modular spring.

A plurality of second modular springs are secured to the intermediate slats and extend upwardly therefrom. Each of these second modular springs is of a fixed second height, has a generally planar upper portion and is secured to one of the intermediate slats. The second height is preferably less than the first height (the height of the first modular springs). When secured to the intermediate slats, the upper portions of each of the second modular springs are generally coplanar with the upper portions of the first modular springs. Thus a generally planar grid may be secured to the upper portions of both sets of modular springs.

A wire grid comprising a plurality of intersecting wires is secured to the upper portions of all of the modular springs of the bedding or seating product. A border wire extends around the periphery of the wire grid. Alternatively, a plastic grid or any other type of structure may be secured to the upper portions of modular springs.

An upholstered covering surrounds the intermediate slats, the base, the spacers, the modular springs and the grid, encompassing the entire interior of the product. Thus, the bedding or seating product of the present invention has an interior divided into two layers by the intermediate slats. The upper layer comprises a plurality of second modular springs and the lower level comprises a series of spacers which are sinuous springs in one embodiment but may be numerous other items including coil or modular springs. In addition, the periphery of the product comprises a plurality of modular springs. Thus, depending on the firmness characteristics of the modular springs of the upper layer and the spacers of the lower layer, different firmness characteristics may be imparted to the bedding or seating product. These and other objects and advantages of the present invention will be more readily apparent from the following drawings.

DETAILED DESCRIPTION OF THE DRAWINGS

Figure 1:
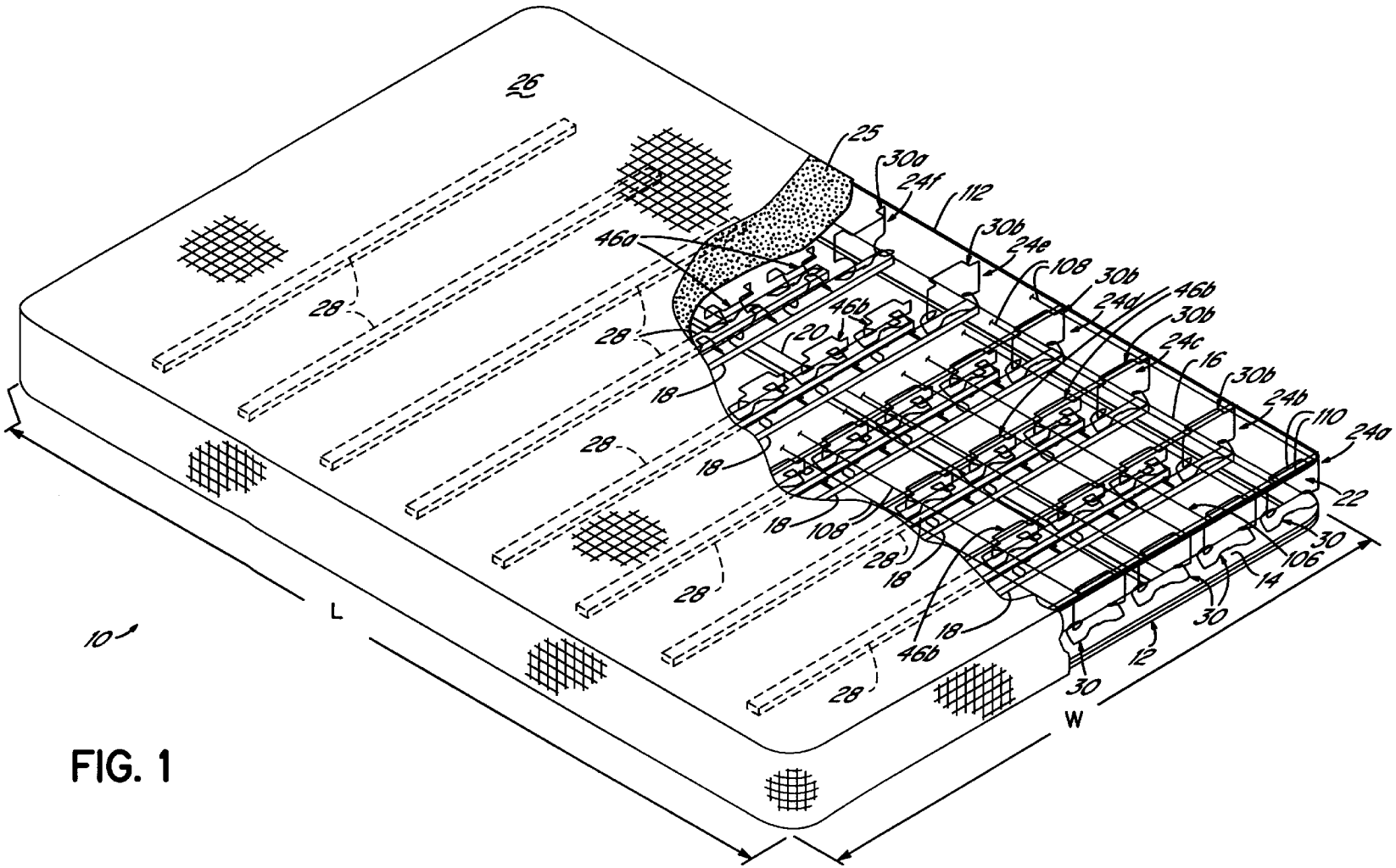
FIG. 1 is a perspective view partially broken away of a bedding or seating product made in accordance with the present invention, the intermediate slats of the product extending transversely.
Figure 1A:
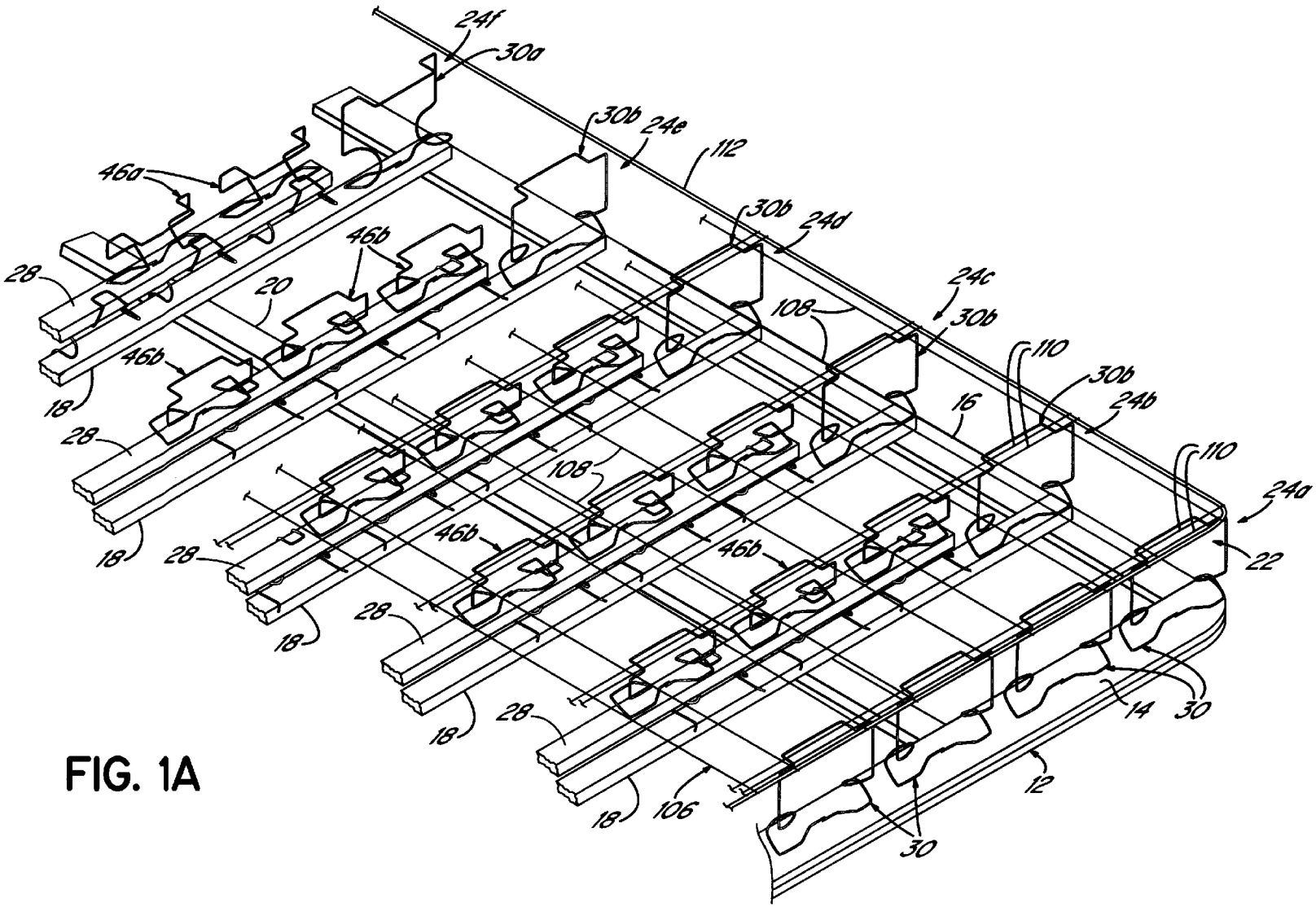
FIG. 1A is a perspective view of the uncovered portion of the bedding or seating product illustrated in FIG. 1.

Referring to the drawings, and particularly to FIGS. 1 and 1A, there is illustrated a bedding or seating product 10 having a wooden base 12. The base includes a pair of end rails 14 (only one being shown), a pair of side rails 16 (only one being shown) and a plurality of intermediate rails 18 which are generally parallel the end rails 14. In addition, the base 12 may have at least one longitudinally extending support rail 20 which passes generally underneath each of the transversely extending intermediate rails 18. A spring interior or core 22 comprising a plurality of springs, which will be described in more detail below, is supported by the rails of the base. The spring interior 22 comprises a plurality of rows of springs 24*a*,24*b*,24*c*,24*d*,24*e*,24*f* . . . In the embodiment illustrated in FIG. 1, the rows of springs 24*a*–24*f* . . . are transversely extending. One or more layers of padding 25 are located above the spring interior 22. An upholstered covering 26 surrounds the base 12, the spring interior 22 and the padding 25.

Figure 3A:
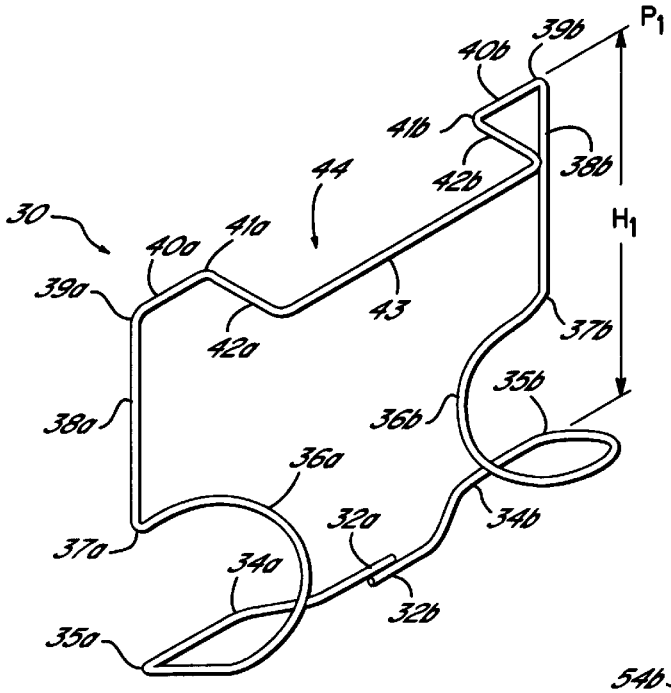
FIG. 3A is a perspective view of one of the first modular springs of the present invention.
Figure 3B:
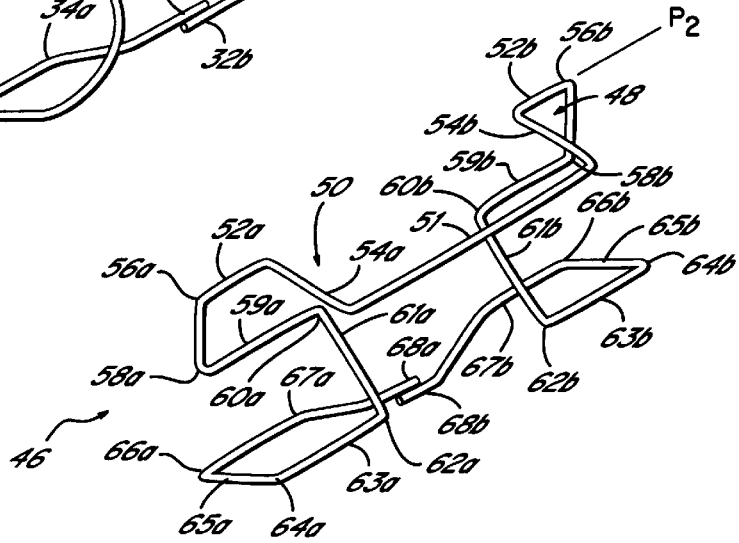
FIG. 3B is perspective view of one of the second modular springs of the present invention.
Figure 3C:
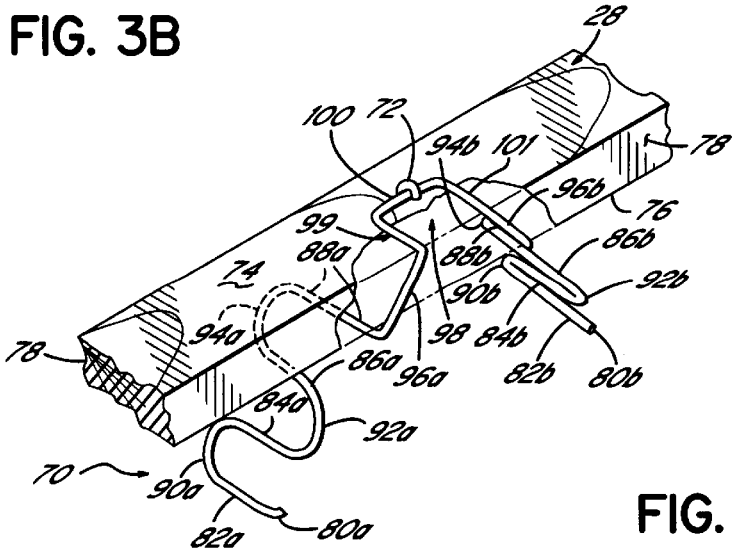
FIG. 3C is a perspective view of one of the sinuous springs of the present invention secured to an intermediate slat.

The spring interior 22 is made up of three different types of springs, which are illustrated in FIGS. 3A,3B and 3C, and a plurality of generally parallel intermediate slats 28 which are located immediately above the intermediate rails 18 of the base 12.

One of these springs is a first modular spring 30, illustrated in FIG. 3A. The first modular spring 30 is made of one piece of wire having end portions 32*a*,32*b* which are welded or otherwise joined together. From the end portions 32*a*,32*b*, the wire extends outwardly along lower portions 34*a*,34*b* until the wire reaches locations 35*a* and 35*b*, at which point the wire rises upwardly and curves into convolutions 36*a*, 36*b*. The convolutions 36*a*,36*b* terminate at locations 37*a*, 37*b*, at which point the wire extends vertically upwardly in vertical portions 38*a* and 38*b*. At locations 39*a*,39*b* the wire turns inwardly and forms colinear upper legs 40*a* and 40*b*. At locations 41*a* and 41*b* the wire makes a right angle and extends outwardly in segments 42*a* and 42*b*. Sections 42*a*, 42*b* are connected by linear segment 43. The first modular spring 30 has a generally planar upper portion 44 made up of the segment 43, the legs 40*a*,40*b* and the segments 42*a*,42*b*, all located in plane $P_1$. The vertical distance from the lower portions of the modular spring 34*a*,34*b* to the generally planar upper portion 44 of the modular spring $H_1$ defines the first height of the first modular spring 30.

FIG. 3B illustrates a second type of modular spring 46 utilized in the spring interior 22 of the present invention. Each of these second modular springs 46 is made of one piece of wire and has a generally planar upper portion 48 located in a generally horizontal plane $P_2$. The generally planar upper portion 48 comprises an offset 51, a pair of opposed colinear legs 52*a* and 52*b*. The offset 50 comprises a central segment 52 and a pair of connecting segments 54*a*,54*b*. The generally planar portion 48 terminates at locations 56*a* and 56*b*, at which point the wire extends vertically downwardly a fixed distance to locations 58*a* and 58*b*. At locations 58*a* and 58*b* the wire extends inwardly along horizontal portions 59*a* and 59*b* until the wire reaches locations 60*a* and 60*b*, at which point the wire extends downwardly and outwardly in portions 61*a* and 61*b*. Portions 61*a* and 61*b* each terminate at locations 62*a* and 62*b*, at which point the wire turns outwardly in forming portions 63*a* and 63*b*, each terminating at locations 64*a* and 64*b*. At locations 64*a* and 64*b* the wire extends downwardly and diagonally in sections 65*a* and 65*b*, each terminating at location 66*a* and 66*b*. From location 66*a* and 66*b* the wire extends inwardly along lower portions 67*a* and 67*b*, each terminating in an end portion 68*a*,68*b*. The end portions 68*a* and 68*b* are welded or otherwise secured together.

Figure 2A:
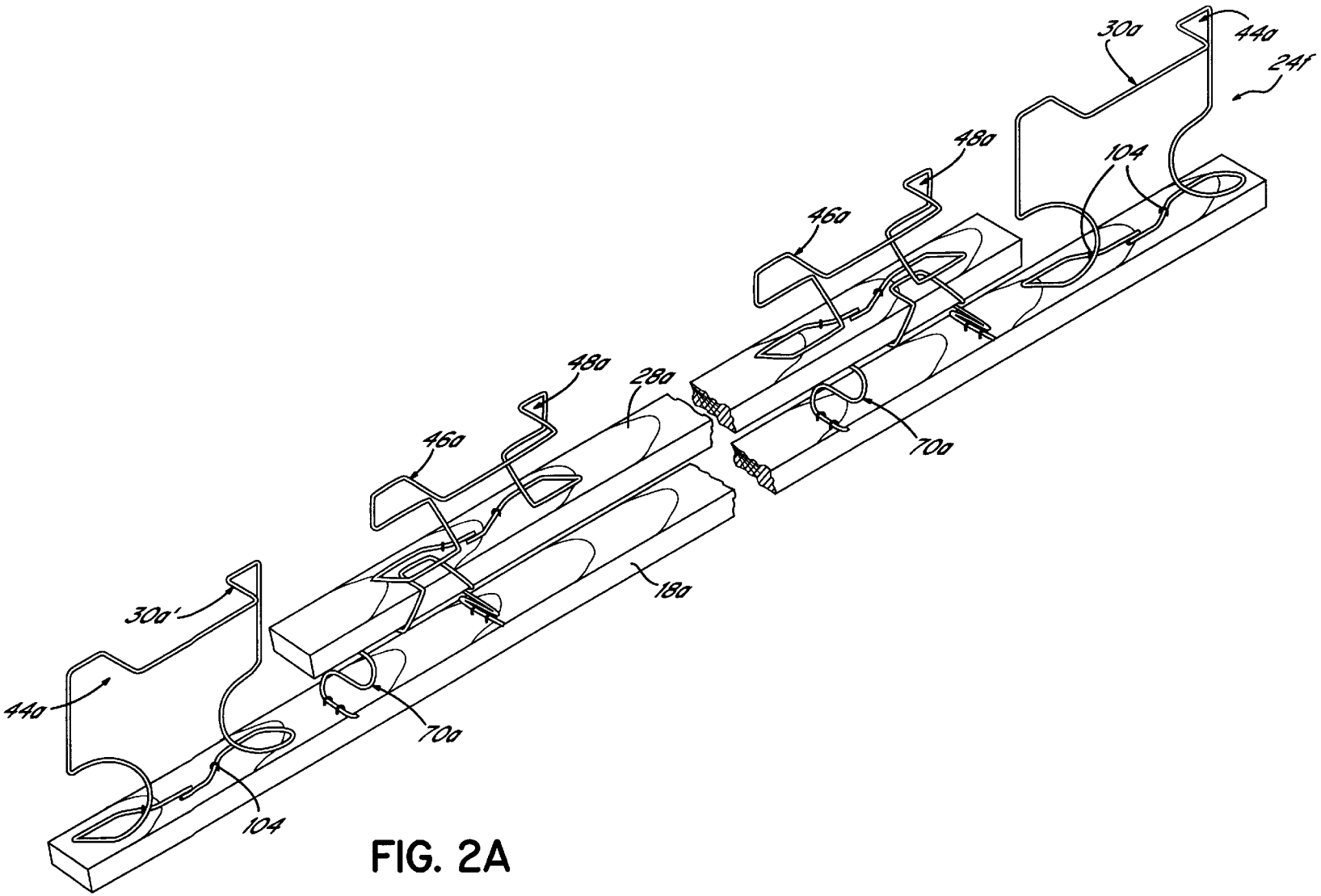
FIG. 2A is a perspective view partially broken away of the row 24*f* of springs of FIG. 1.
Figure 2B:
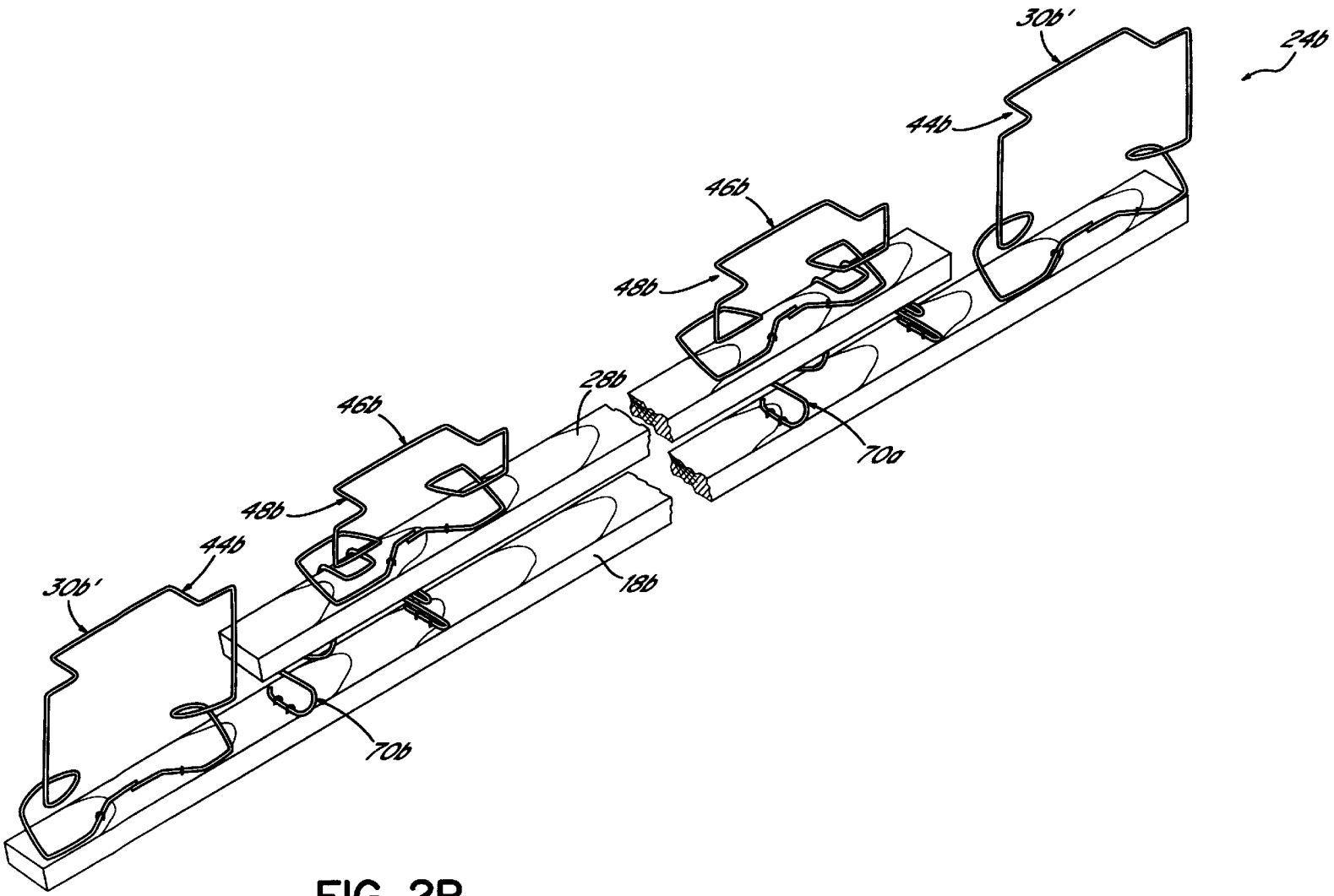
FIG. 2B is a perspective view partially broken away of the row 24*b* of springs of FIG. 1.

As illustrated in FIGS. 2A and 2B, which will be described in more detail below, the lower portions 67*a* and 67*b* of the second modular springs 46 are adapted to rest upon and be secured to an intermediate slat 28 with staples or any other fasteners. Each of the second modular springs 46 extends upwardly from an intermediate slat whereas each of the first modular springs 30 extends upwardly from the base 12.

Referring now to FIG. 3C, a sinuous spring 70 made of one piece of wire is illustrated secured to one intermediate slat 28 with a staple 72. The intermediate slat 28 has a top surface 74, a bottom surface 76 and a pair of opposed side surfaces 78. Each sinuous spring 70 is configured so as to receive and be secured to one of the intermediate slats 28 with at least one staple 72. Although the staple 72 is illustrated as being located in one position, other locations may be utilized as well. In addition, fasteners other than staples may be used to secured the sinuous springs 70 to the intermediate slats 28.

Each sinuous spring 70 is made of one piece of wire having opposed ends 80*a* and 80*b*. Extending inwardly from ends 80*a* and 80*b* are linear segments 82*a* and 82*b*. Located above linear segments 82*a* and 82*b* are linear segments 84*a* and 84*b*, linear segments 86*a* and 86*b*, and 88*a* and 88*b* joined together with arcuate segments 90*a*,90*b*; 92*a*,92*b* and 94*a*,94*b*. Extending upwardly from the end of linear segments 88*a*,88*b* are vertical segments 96*a* and 96*b* which abut one of the side surfaces 78 of the intermediate slat 28. The last portion of the sinuous spring 70 is a three-sided generally planar top portion 98 comprising sides 99,100,101, each side being a linear segment. The top portion 98 rests upon the upper surface 74 of the intermediate slat 28 and is secured thereto.

Although one configuration of sinuous spring 70 is illustrated and described, other configurations may be utilized as well. For example, the sinuous spring may not extend above the side surfaces of the intermediate slat, in which case the sinuous spring is secured to the bottom of the intermediate slat. In addition, a continuous sinuous spring may extend along the length of each of the intermediate slats underneath the slats, as opposed to a series of spaced, discontinuous sinuous springs 70. As mentioned above, alternative configurations of springs as well as non-spring spacers such as foam blocks may be utilized to space the intermediate slats 28 above the intermediate rails 18 of the base 12.

Referring back to FIGS. 1 and 1A, row 24*a* comprises a plurality of spaced first modular springs 30 supported by one of the end rails 14 of the base. More particularly, the lower portions 34*a*,34*b* of each of the first modular springs 30 are stapled or otherwise secured to the end rail of the base, with each of the first modular springs being oriented identically. Although not shown, the opposite end rail 14 of the base 12 of the bedding or seating product 10 similarly has a row of first modular springs 30 secured thereto extending across the width of the base.

FIG. 2A illustrates one of the intermediate row 24*f* of the spring interior 22. Row 24*f* of springs comprises a pair of endmost first modular springs 30*a*,30*a*'. Each of these first modular springs 30*a*,30*a*' is secured to the one of the intermediate rails 18*a* of the base 12 with staples 104. Between the endmost first modular springs 30*a*,30*a*' is an intermediate slat 28*a* located directly above the intermediate rail 18*a* of the base and generally parallel thereto. However, the length of the intermediate slat 28*a* is less than the length of the intermediate rail 18*a*. Extending between the intermediate slat 28*a* and the intermediate rail 18*a* of the base are a plurality of sinuous springs 70*a*. The sinuous springs 70*a* are secured to the intermediate slat 28*a* and the intermediate rail 18*a*. The sinuous springs 70*a* function to hold the intermediate rail 28*a* in place as well as increase the resiliency of the bedding or seating product.

A plurality of spaced second modular springs 46*a* are secured to the intermediate slat 28*a* and extend upwardly therefrom. The planar upper portions 48*a* of the second modular springs 46*a* are generally coplanar with the generally planar upper portions 44*a* of the first modular springs 30*a*,30*a*' in order to easily secure a wire grid 106 (illustrated in FIG. 1) to the upper portions of the springs.

Referring to FIGS. 1 and 1A, the wire grid 106 comprises a plurality of longitudinally extending wires 108 intersecting with a plurality of transversely extending wires 110. The intersecting wires are surrounded with a generally rectangular border wire 112, as is conventional. Although one configuration of grid 108 is illustrated as described, other configurations of grids may be used in accordance with the present invention, and secured to the modular springs any number of ways.

Each of the rows 24*b*–24*e* is configured and oriented identically, row 24*b* being illustrated in detail in FIG. 2B. However, rows 24*f* on to the last intermediate row of the bedding or seating product (excluding the end row of first modular springs) are oriented differently than rows 24*b*–*e*. One of these rows, row 24*f* is illustrated in detail in FIG. 2A. Each of these rows is identical to the row 24*b* illustrated in FIG. 2B except rotated 180° C., that is, the orientation of the modular springs and sinuous springs is different. FIG. 2B illustrates a pair of outermost first modular springs 30*b* and 30*b*' secured to an intermediate rail 18*b* of the base 12. Also illustrated is an intermediate slat 28*b* located directly above the intermediate rail 18*b* of the base. A plurality of sinuous springs 70*b* are located between the intermediate rail 18*b* of the base and the intermediate slat 28*b* but are oriented oppositely from those sinuous springs 70*a* illustrated in FIG. 2A. Similarly, FIG. 2B illustrates a plurality of second modular springs 46*b* which are oriented differently than the second modular springs 46*a* illustrated in FIG. 2A. The purpose of orienting the springs differently in the different rows is to help stabilize the grid 106 secured to the upper portions of the modular springs. However, it is within the contemplation of this invention that all of the modular springs be oriented the same way, alternate orientations every other row, or some other variation thereof.

Figure 4:
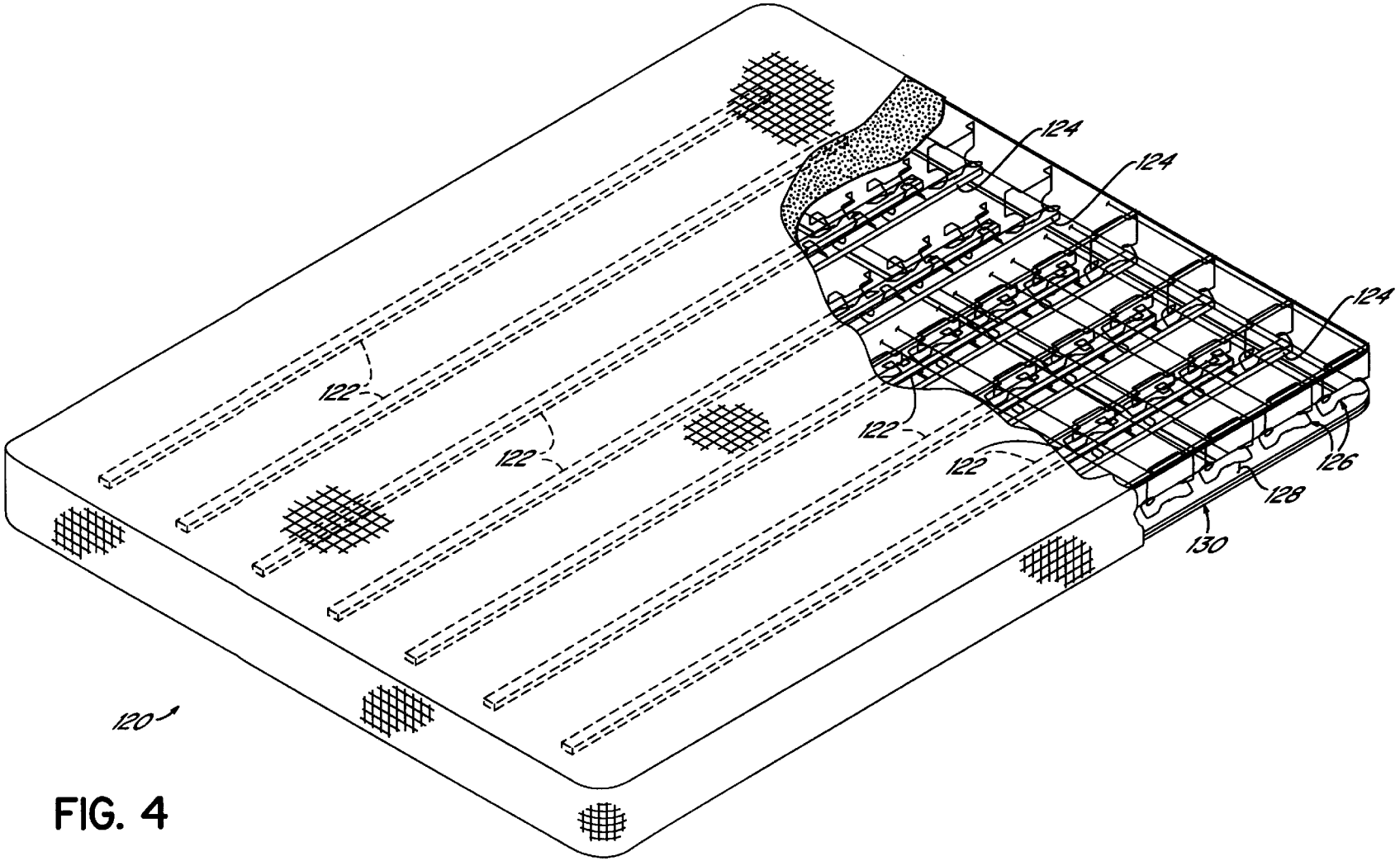
FIG. 4 is a perspective view partially broken away of a bedding or seating product made in accordance with the present invention, the product having longitudinally extending intermediate slats.

Although FIGS. 1 and 1A illustrate the rows of springs extending transversely, the rows of springs may extend longitudinally as well. FIG. 4 illustrates a bedding or seating product 120 in which the intermediate slats 122 and intermediate rails 124 of the base 130 extend longitudinally. In this embodiment rows of first modular springs 126 are located along the side rails 128 of the base 130.

While I have described several preferred embodiments of the bedding or seating product of the present invention, persons skilled in the art will appreciate changes and modifications which may be made to the present invention without departing from the spirit of the invention of this application. For example, resilient foam blocks or other configurations of springs may be used instead of sinuous springs in order to space the intermediate slats above the intermediate rails. Similarly, other configurations of springs may be used in place of the modular springs atop the intermediate slats or on the end rails of the wooden frame. Therefore I intend to be limited only by the scope of the following claims.

I claim:

1. A bedding or seating product comprising:

a base comprising a pair of end rails, a pair of side rails and a plurality of intermediate rails, a plurality of intermediate slats spaced above said intermediate rails, a plurality of spacers extending between said intermediate slats and said intermediate rails, each of said spacers being secured to one of said intermediate slats and one of said intermediate rails, a plurality of modular springs secured to said intermediate slats and extending upwardly therefrom, a grid secured to said modular springs, and an upholstered covering surrounding said slats, intermediate slats, spacers, modular springs and grid.

2. A bedding or seating product comprising:

a base comprising a pair of end rails, a pair of side rails and a plurality of intermediate rails, a plurality of intermediate slats spaced above said intermediate rails, a plurality of spacers extending between said intermediate slats and said intermediate rails, each of said spacers being secured to one of said intermediate slats and one of said intermediate rails, a plurality of modular springs secured to said intermediate slats and extending upwardly therefrom, a grid secured to said modular springs.

3. The bedding or seating product of claim 2 wherein said spacers are springs.

4. A bedding or seating product comprising:

a base comprising a pair of end rails, a pair of side rails and a plurality of intermediate rails, a plurality of intermediate slats spaced above said intermediate rails, a plurality of sinuous springs extending between said intermediate slats and said intermediate rails, each of said sinuous springs being secured to one of said intermediate slats and one of said intermediate rails, a plurality of modular springs secured to said intermediate slats and extending upwardly therefrom, a grid secured to said modular springs.

5. The bedding or seating product of claim 2 wherein said intermediate slats are wooden.

6. The bedding or seating product of claim 2 wherein said base is wooden.

7. The bedding or seating product of claim 2 wherein said spacers are stapled to said intermediate slats and to said intermediate rails of said base.

8. A bedding or seating product comprising:

a base comprising a pair of transversely extending end rails, a pair of longitudinally extending side rails and a plurality intermediate rails, a plurality of intermediate slats spaced above said intermediate rails, each of said intermediate slats being directly above and parallel one of said intermediate rails of said base, a plurality of spacers extending between said intermediate slats and said intermediate rails, a plurality of springs of a first height secured to said base and extending upwardly therefrom, a plurality of springs of a second height secured to said intermediate slats and extending upwardly therefrom, said second height being less than said first height, a grid secured to said springs.

9. The bedding or seating product of claim 8 wherein said spacers are sinuous springs.

10. The bedding or seating product of claim 8 wherein said intermediate slats are wooden.

11. The bedding or seating product of claim 8 wherein said base is wooden.

12. The bedding or seating product of claim 8 wherein said spacers are stapled to said intermediate slats and to said intermediate rails of said base.

13. A bedding or seating product comprising:

a base comprising a pair of end rails, a pair of side rails and a plurality of intermediate rails, a plurality of intermediate wooden slats spaced above said intermediate rails, each of said intermediate wooden slats being directly above and parallel one of said intermediate rails, a plurality of sinuous springs extending between said intermediate wooden slats and said intermediate rails, each of said sinuous springs being secured to one of said intermediate wooden slats and one of said intermediate rails, a plurality of modular springs secured to said intermediate wooden slats and extending upwardly therefrom, a grid secured to said modular springs.

14. A bedding or seating product comprising:

a base comprising a pair of end rails, a pair of side rails and a plurality of intermediate rails, a grid spaced above said base, a plurality of intermediate slats spaced above said intermediate rails of said base and below said grid, a plurality of spacers extending between said intermediate slats and said intermediate rails, each of said spacers being secured to one of said intermediate slats and one of said intermediate rails, a plurality of springs secured to said intermediate slats and extending between said intermediate slats and said grid.

15. A bedding or seating product comprising:

a base comprising a pair of end rails, a pair of side rails and a plurality of intermediate rails, a plurality of intermediate slats spaced above said intermediate rails, a plurality of sinuous springs extending between said intermediate slats and said intermediate rails, each of said sinuous springs being secured to one of said intermediate slats and one of said intermediate rails, a plurality of springs secured to said intermediate slats and extending upwardly therefrom.

16. The product of claim 15 further comprising a grid secured to upper portions of said springs.

17. A bedding or seating product comprising:

a base comprising a pair of end rails, a pair of side rails and a plurality of intermediate rails, a plurality of intermediate slats spaced above said intermediate rails, a plurality of spacers extending between said intermediate slats and said intermediate rails, each of said spacers being secured to one of said intermediate slats and one of said intermediate rails, a plurality of modular springs secured to said intermediate slats and extending upwardly therefrom.

18. The product of claim 17 further comprising a grid secured to upper portions of said modular springs.

* * * * *